US008833004B2

(12) United States Patent
Prass

(10) Patent No.: US 8,833,004 B2
(45) Date of Patent: Sep. 16, 2014

(54) FOUNDATION FOR A WIND TURBINE

(75) Inventor: Gregor Prass, Hamburg (DE)

(73) Assignee: Timbertower, GmbH, Hannover (DE)

( * ) Notice: Subject to any disclaimer, the term of this patent is extended or adjusted under 35 U.S.C. 154(b) by 0 days.

(21) Appl. No.: 13/877,651

(22) PCT Filed: Sep. 30, 2011

(86) PCT No.: PCT/EP2011/004879

§ 371 (c)(1),
(2), (4) Date: Aug. 29, 2013

(87) PCT Pub. No.: WO2012/045413

PCT Pub. Date: Apr. 12, 2012

(65) Prior Publication Data

US 2013/0326970 A1 Dec. 12, 2013

(30) Foreign Application Priority Data

Oct. 8, 2010 (DE) ..... 10 2010 047 773

(51) Int. Cl.
*E04B 1/00* (2006.01)
*E04C 3/00* (2006.01)
*E02D 27/42* (2006.01)

(52) U.S. Cl.
CPC ..... *E02D 27/425* (2013.01); *E02D 27/42* (2013.01)
USPC ..... 52/169.1; 52/831; 52/834

(58) Field of Classification Search
USPC ..... 52/831, 834, 843–851
See application file for complete search history.

(56) References Cited

U.S. PATENT DOCUMENTS

| | | | | |
|---|---|---|---|---|
| 4,794,742 | A * | 1/1989 | Henderson | 52/80.2 |
| 5,733,671 | A * | 3/1998 | Bayasi | 428/703 |
| 6,380,909 | B1 * | 4/2002 | Wilkinson et al. | 343/890 |
| 8,359,798 | B2 * | 1/2013 | Armbrecht et al. | 52/297 |
| 8,516,774 | B2 * | 8/2013 | Zavitz et al. | 52/745.18 |
| 2009/0019816 | A1 * | 1/2009 | Lockwood et al. | 52/848 |
| 2009/0255200 | A1 * | 10/2009 | Leon Perfecto | 52/298 |
| 2010/0043318 | A1 * | 2/2010 | Armbrecht et al. | 52/173.1 |
| 2010/0132270 | A1 * | 6/2010 | Willey et al. | 52/79.5 |
| 2011/0061321 | A1 * | 3/2011 | Phuly | 52/297 |
| 2011/0138720 | A1 * | 6/2011 | Tooman et al. | 52/295 |
| 2012/0011801 | A1 * | 1/2012 | Schiffer et al. | 52/742.16 |
| 2012/0137620 | A1 * | 6/2012 | Gevers et al. | 52/651.01 |
| 2012/0291380 | A1 * | 11/2012 | Tooman | 52/297 |
| 2013/0108465 | A1 * | 5/2013 | Prass | 416/244 R |

* cited by examiner

*Primary Examiner* — Mark Wendell
(74) *Attorney, Agent, or Firm* — Mark Rodgers

(57) ABSTRACT

The invention relates to a foundation for a wind turbine, comprising an above-ground and a below-ground part (11, 12), wherein a connection facility (14) for a wind turbine is provided on the above-ground part (12), characterized in that the below-ground part (11) is produced at least partially from a wood-based material.

8 Claims, 4 Drawing Sheets

FOUNDATION FOR A WIND TURBINE

Figure 1:
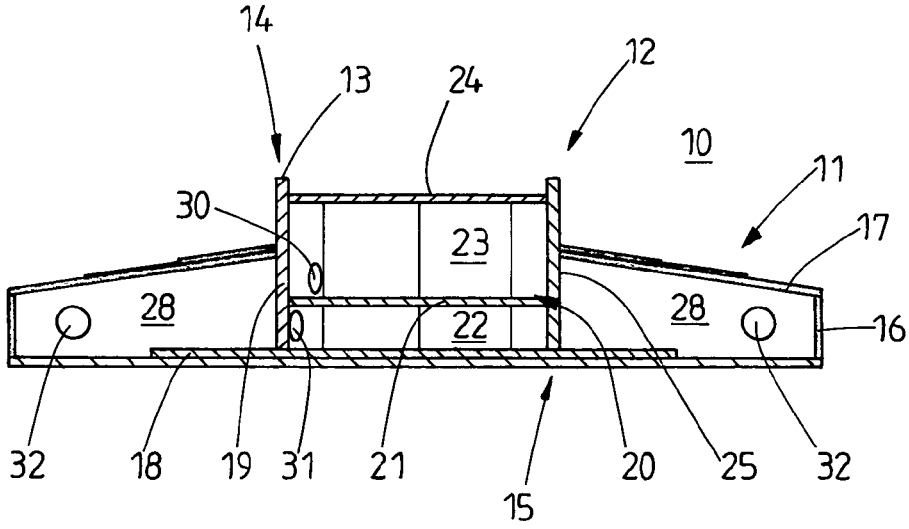

The invention relates to a foundation for a wind turbine, comprising an above-ground and a below-ground part, wherein a connection facility for a wind turbine is provided on the above-ground part. Furthermore, the invention relates to a wind turbine having an above-described foundation.

Use is made of wind turbines to generate electrical energy from wind. A wind turbine is a device having a foundation, a tower which is erected on the foundation, and a pod which is arranged on the tower. The drive unit connected to rotor blades and intended for generating energy is situated on the pod.

The static loads produced by the pod on the tower and the dynamic loads produced by the rotation of the rotating blades of the rotor and the capability of the pod to move, depending on the wind direction, are dissipated via the tower, which is designed for this purpose, into the foundation of the wind turbine.

Such foundations are produced, for example, as flat foundations in the form of concrete bodies as solid bodies. A disadvantage with such bodies is that, after reaching the end of the useful life of the wind turbine, after the wind turbine has to be dismantled, the foundation likewise has to be dismantled in a complicated manner. Furthermore, in particular during the production of the foundation as a solid body, the production costs owing to the reinforced concrete foundation are very high.

DE 102 45 078 A1 discloses a wind turbine in the form of an above-ground foundation in which the turbine is erected on a container. A disadvantage here is that the loads which can be absorbed by such a container are too small for it to be possible to erect thereon a nowadays customary, permanently installed wind turbine.

A possibility of reducing material is disclosed in WO 02/27105 A1. Here, a foundation of reinforced concrete is produced which consists of ring segments which are erected as open bodies in the ground, which means that no solid body is used, resulting in material savings and hence cost savings. However, it is also necessary here to provide complicated dismantling measures.

A further way of reducing the costs is disclosed in EP 1 074 663 A1. Here, a star-shaped concrete foundation is provided consisting of three sections which are arranged on a base section on which the wind turbine is erected. At the end points, the sections are additionally secured in the form of a deep foundation additionally for absorbing loads. Although the design as a solid body is provided, and the required mass is reduced by reducing the extension arms and by the additional deep foundation, leading to a cost reduction, complicated dismantling still remains.

Therefore, it is an object of the invention to provide a foundation for a wind turbine in which, on the one hand, a cost reduction is achieved over the known foundations, it is possible at the same time to absorb the necessary loads and it is possible to reduce the costs and the complexity when dismantling the foundation.

The object according to the invention is achieved with respect to the foundation in that the below-ground part is produced at least partially from a wood-based material.

A wood-based material is capable of absorbing the static and dynamic loads caused by the wind turbine equally well, or even better, as or than a concrete foundation. At the same time, the erection costs in relation to 1 $m^3$ mass are up to 30% less. At the same time, the complexity for the dismantling measures after the end of the service life of the wind turbine is reduced since it can be demounted more easily than a comparable concrete foundation. Furthermore, the decomposition processes beginning during the service life of the wood foundation likewise facilitate the dismantling, or the dismantleability no longer becomes necessary since it is ensured that the dismantling process is carried out naturally in that the wood-based material is decomposed over a defined period.

A further teaching of the invention provides that the below-ground part is at least partially a hollow body. By providing a hollow body while maintaining the static and dynamic loadability, it is possible to further reduce the erection costs. Furthermore, it is advantageous for a supporting structure, preferably of a wood-based material, to be provided on a base plate, preferably of a wood-based material, on which supporting structure panels, preferably of a wood-based material, are mounted. It is advantageous here for supporting elements to be provided in the interior of the below-ground part, preferably radially outwardly directed from the center point of the foundation, preferably as a constituent part of the supporting structure, and/or for a central region divided into at least two sections to be provided, wherein the division preferably occurs in the horizontal direction. The provision of such a construction makes it possible to transport the necessary materials in a simple manner to the erection site, since there is no need for a high degree of prefabrication in the form of voluminous parts. Furthermore, it is possible, given uniform static and dynamic loadability, to reduce the used materials further. Alternatively, it is advantageous to produce the foundation body completely from a wood-based material.

A further teaching of the invention provides that the above-ground part is placed on a bearing, which is preferably set on a bearing plate, or is designed to be extended, preferably in one piece, into the below-ground part, which is preferably set on a bearing plate. In such a way, the loads which occur can be transmitted more simply into the foundation.

A further teaching of the invention provides that the wood-based material is solid wood, glued laminated wood and/or cross-laminated wood. These wood-based materials are easily available, cost-effective materials having correspondingly sufficient static and dynamic loadability.

A further teaching of the invention provides that means for ventilating the hollow body are provided, which are preferably openings in the supporting structure and/or divided central sections. The provision of ventilation makes it possible to have a positive influence on the life expectancy of the wood-based materials corresponding to the necessary parameters.

Furthermore, the object according to the invention is achieved with respect to the wind turbine by means of a wind turbine having a foundation of the above-described type in that the heat occurring in the wind turbine is introduced into the foundation. Furthermore, the object according to the invention is achieved by the use of the heat occurring in the wind turbine for drying a foundation of the above-described type.

Figure 2:
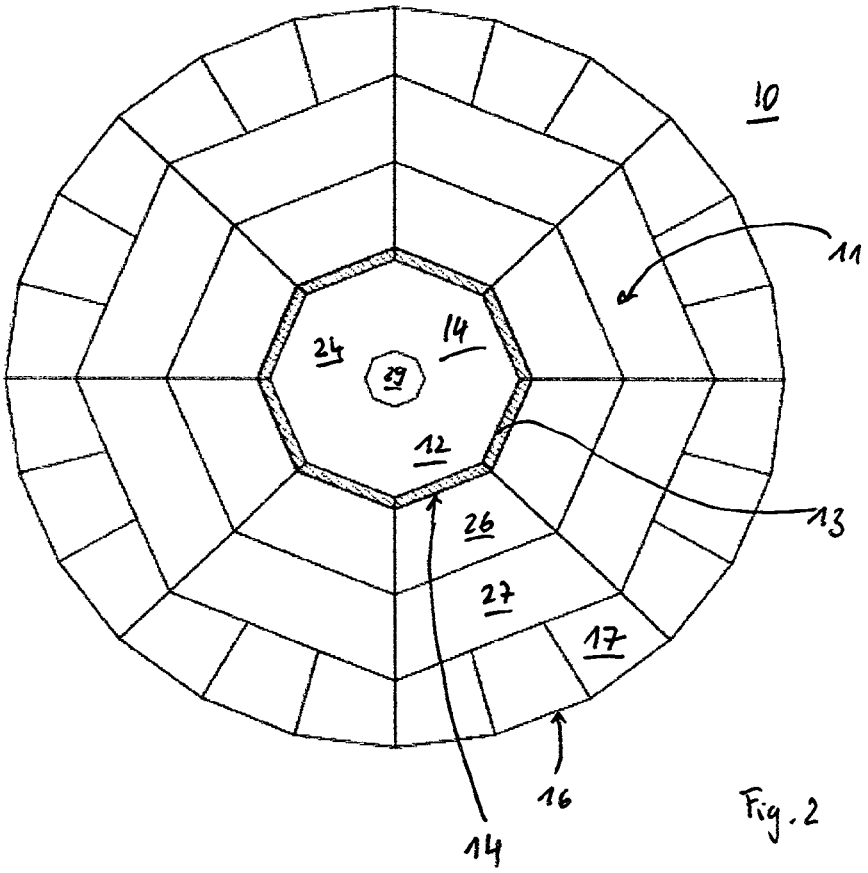
Figure 3:
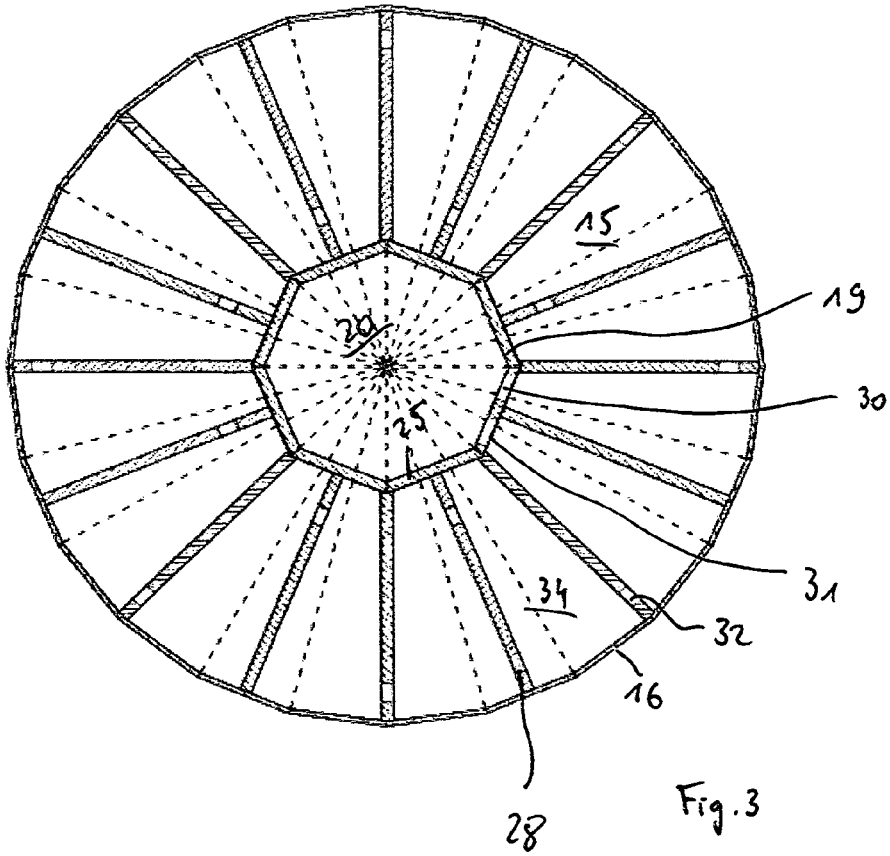
Figure 4:
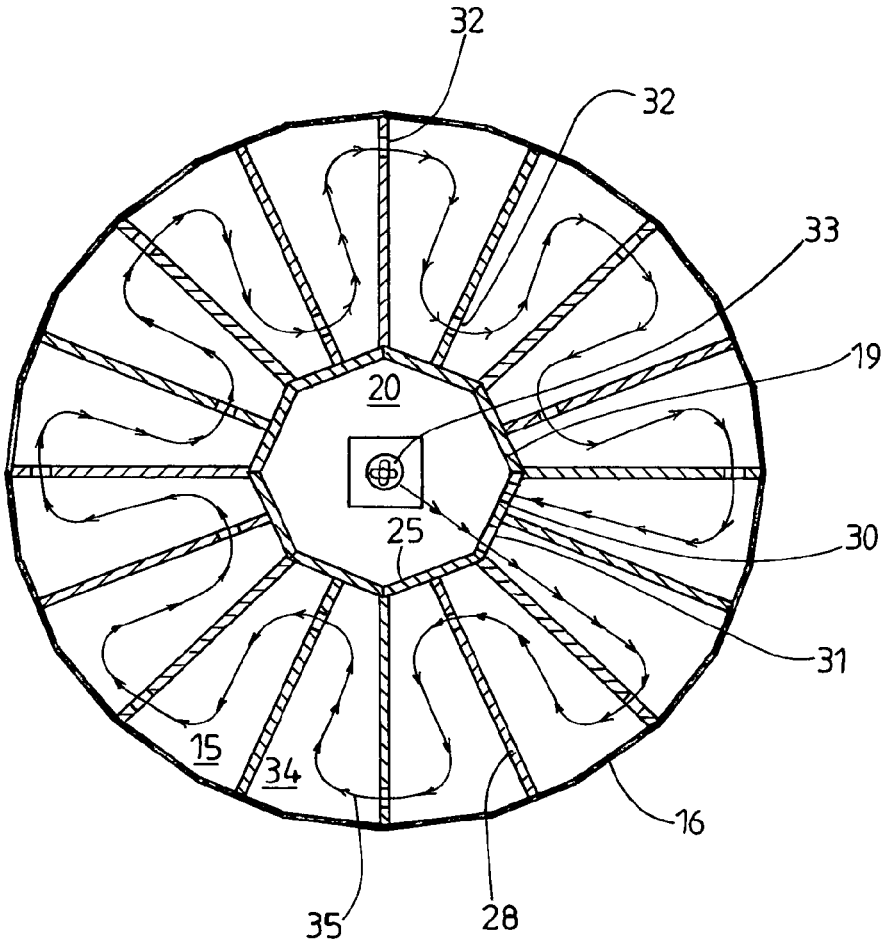

The invention will be explained in greater detail below with reference to an exemplary embodiment in conjunction with a drawing, in which:

FIG. 1 shows a lateral side view of a foundation according to the invention, FIG. 2 shows a plan view of FIG. 1, FIG. 3 shows a sectional view in plan view below the sight plane of FIG. 2, and FIG. 4 shows a view analogous to FIG. 3 with ventilation path represented.

The foundation 10 according to the invention consists of a below-ground part 11 and an above-ground part 12. On an upper side of the above-ground part 12, which can be designed to be annular or polygonal, a connection for a tower of a wind turbine is situated. Advantageously, the tower of the wind turbine is likewise designed as a polygonal tower made of wood. The below-ground part 11 is, for example, built on a base plate (not shown) which serves as an erection base. This can be a concrete slab or else a compacted sand foundation or the like. A base of wood is erected on the base plate. Vertical side walls 16 are erected on the base 15. Furthermore, a bearing plate 18 is provided. A bearing 19 is provided centrally on the base plate 15 or the bearing plate 18. The bearing 19 serves either as a connection for the above-ground part 12 or, as is shown in FIG. 1, is designed in one piece therewith. The bearing 19 consists of vertically arranged panels 25 which form a central section 20. The central section 20 has a horizontal central panel 21 as separating plane. A cover 24 is provided in the upper part. The space between the cover 24 and central panel 21 is an upper chamber 23. Between the central panel 21 and the bearing plate 18 or the base 15 there is a lower chamber 22.

Adjoining the vertical side walls 16 are inclined side walls 17. The base has a polygonal shape with which an approximation to a circle is produced in certain circumstances (see FIGS. 2 to 4). The inclined side walls 17 have a trapezoidal design. This is depicted in plan view in FIG. 2 and in dashed line in FIG. 3. Bearing plates 26, 27 of different thickness are provided as reinforcements and are arranged on the inclined side walls 17. These are likewise trapezoidal but cover a plurality of inclined side walls 17.

Alternatively or in addition, supporting wall elements 28 can be provided within the foundation 10, radially from the central section 20 to the vertical side walls 16. These can be provided under the contact points of the inclined side walls 17 or, as represented in FIG. 3, be provided offset thereto. Alternatively, the foundation can be erected with a supporting framework (not shown) on which corresponding wooden panels are then applied.

The walls 16, 17, 25, 28, panels 21, 25, 26, 27, the base 15 and the bearing 20 consist either of layer elements arranged above one another or of panel elements which are produced from glued laminated wood or cross-laminated wood.

The means provided for ventilating the foundation are openings 29 in the cover 24 through which supply air and moist exhaust air can be transported. Furthermore, the vertical side walls 25 have openings 30, 31, of which one is situated in the lower chamber 22 and one in the upper chamber 23. The chambers 22, 23 are separated from one another in terms of ventilation. Between the vertical side walls 16 and the panel 25, further chambers 34 are formed by the wall elements 28. These chambers 34 are connected to one another in terms of ventilation via openings 32 in the wall elements 28. By way of example, FIG. 4 depicts a fan 33 by means of which the air is moved along the ventilation path 35 represented in FIG. 4.

LIST OF REFERENCE SIGNS

10 Foundation
11 Below-ground part
12 Above-ground part
13 Tower connection
14 Upper side
15 Base
16 Side wall, vertical
17 Side wall, inclined
18 Bearing plate
19 Bearing
20 Central section
21 Central panel
22 Lower chamber
23 Upper chamber
24 Cover
25 Panel
26 Bearing plate
27 Bearing plate
28 Wall element
29 Opening
30 Opening
31 Opening
32 Opening
33 Fan
34 Chamber
35 Ventilation path

The invention claimed is:

1. A foundation for a wind turbine, comprising an above-ground and a below-ground part, wherein a connection facility for a wind turbine is provided on the above-ground part, and the below-ground part is produced at least partially from a wood-based material, further comprising a supporting structure of a wood-based material on a base plate of wood-based material, wherein the supporting structure at least one consists of panels of a wood based material or includes mounted panels of a wood based material.

2. The foundation as claimed in claim 1, wherein the below-ground part is at least partially a hollow body.

3. The foundation as claimed in claim 2, comprising supporting elements in the interior of the below-ground part wherein the supporting elements are at least one of;

radially outwardly directed from the center point of the foundation as a constituent part of the supporting structure or, comprising a central region divided into at least two sections, wherein the division preferably occurs in the horizontal direction.

4. The foundation as claimed in claim 2, wherein at least one of the above-ground part or the below ground part comprises a bearing and a bearing plate.

5. The foundation as claimed in claim 1, wherein the wood-based material is at least one of solid wood, glued laminated wood or cross-laminated wood.

6. The foundation as claimed in claim 1, comprising means for ventilating the hollow body, wherein the ventilating means comprises openings in a supporting structure and divided central sections.

7. The foundation as claimed in claim 1, wherein the foundation has a polygonal shape.

8. The foundation of claim 1 comprising means for introducing heat occurring in the wind turbine into the foundation.

* * * * *